US005303490A

United States Patent [19]

Yang

[11] Patent Number: 5,303,490

[45] Date of Patent: Apr. 19, 1994

[54] DISPLAY SHOWING MOVABLE ORNAMENTS

[76] Inventor: Steve Yang, 9 FL.-17, No. 3, Tien Mou W. Road, Shi-lin, Taipei, Taiwan

[21] Appl. No.: 904,542

[22] Filed: Jun. 26, 1992

[51] Int. Cl.[5] ..... G09F 19/08

[52] U.S. Cl. ..... 40/414; 40/455; 362/234; 428/13

[58] Field of Search ..... 40/414, 419, 420, 423, 40/429, 430, 431, 418, 470, 550, 455; 362/234, 252; 428/7, 13; 446/149, 485

[56] References Cited

U.S. PATENT DOCUMENTS

| | | | |
|---|---|---|---|
| 2,254,091 | 8/1941 | Rossi | 40/420 X |
| 2,405,376 | 8/1946 | Stubbins | 40/420 X |
| 2,821,801 | 2/1958 | Pruitt, Sr. | 40/420 |
| 3,191,020 | 6/1965 | Miller | 362/252 X |
| 4,577,264 | 3/1986 | Plumly | 362/252 |
| 4,682,079 | 7/1987 | Sanders et al. | 428/7 X |
| 4,823,240 | 4/1989 | Shenker | 362/234 X |
| 4,989,120 | 1/1991 | Davis et al. | 428/13 X |

*Primary Examiner*—Brian K. Green

*Attorney, Agent, or Firm*—Lowe, Price, LeBlanc & Becker

[57] ABSTRACT

A display device has a housing in which sound (a music IC), light (light strings), and power (light string AC motors) elements are combined. At least one master light string is used as the power source, supplying the AC motor necessary power so that the motor can drive a transmission mechanism. Ornaments connected to the transmission mechanism are then movable in the display device providing an attractive and lovely scene. Separate toy figures having an independent light string AC motor may be directly connected to the light string which provides power required for the toy figures to move in a designed manner.

6 Claims, 3 Drawing Sheets

DISPLAY SHOWING MOVABLE ORNAMENTS

BACKGROUND OF THE INVENTION

The present invention relates to a display means attractively showing movable ornaments therein, and more particularly to a display means which uses a light string as the power supply to connect a light string AC motor for driving ornaments in the display means to move in different manners before a background. Such display means may be conveniently positioned on a window sill, desk top, or top of a fireplace, or may be hung or mounted on walls. The display means according to the present invention is simple in the whole structure and safe in use. The ornaments displayed in front of the display means can be designed to move lively so as to match different meaningful events.

Ornaments are frequently used in holidays or festivals to create happy and joyous air. For Christmas holidays, all kinds of beautiful and cute ornaments and decorations play important roles in show windows. In conventional show windows, ornaments and decorations displayed are usually stationary and motionless, the only means used to give such ornaments and decorations some changes is their different appearances and some light strings attached to them. On the other hand, to use movable ornaments and decorations, additional costs for extra power supply and parts are extremely high. It is therefore tried by the applicant to develop a display means which has movable ornaments and decorations while the entire structure of the display means is simple.

SUMMARY OF THE INVENTION

The primary object of the present invention is to provide a display means which consists of a formed housing in which a master light string, a light string AC motor, and a set of transmission mechanisms driven by the motor are contained to give the ornaments and decorations in front of the display means changes in light, color, and motion. With a matched background and other ornaments in the display means, what is shown in the display means is a beautiful and lovely story rather than some motionless objects.

Another object of the present invention is to provide a display means in which every socket contained in the master light string can serve as a power source, permitting individual ornaments or toy figures having an independent light string AC motor as disclosed in the U.S. patent application Ser. No. 07/727,439 to connect thereto and be driven to move in different manners.

Bulbs used in the master light string can be common bulbs that do not flash when the master light string connects to the light string AC motor. A flashing light strings may be connected in parallel to the master light string to create attractive changes in light and color in the display means.

It is still another object of the present invention to provide the above-described display means in which a music IC can be included so that beautiful music can together with the movable ornaments and decorations make the display means more attractive.

BRIEF DESCRIPTION OF THE DRAWINGS

The other features and functions of the display means according to the present invention can be better understood by referring to the following detailed description of the preferred embodiments and the accompanying drawings, wherein.

DETAILED DESCRIPTION OF THE PREFERRED EMBODIMENTS

Figures 1, 4:
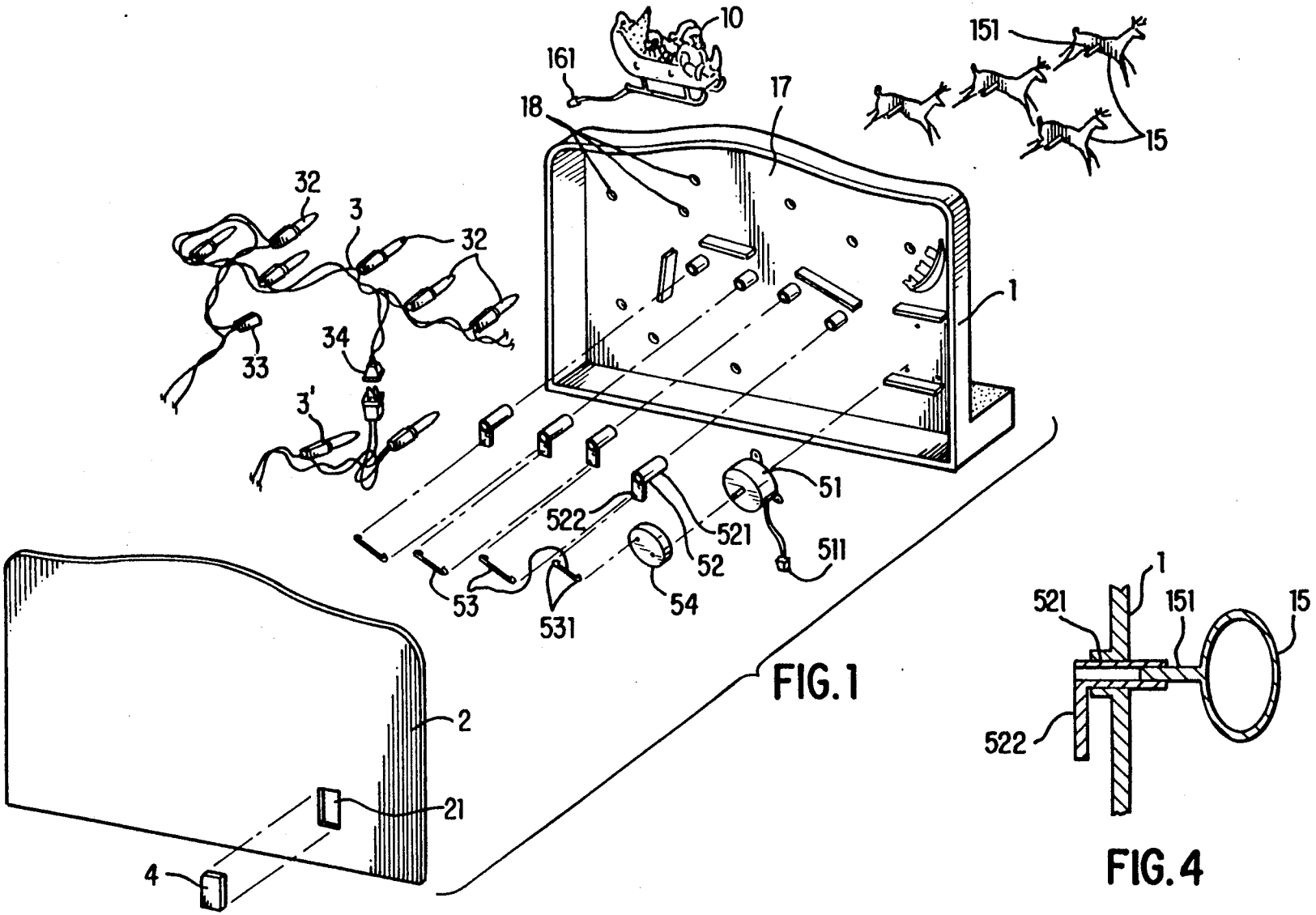
FIG. 1 is a three-dimensional analytical perspective of a display means according to the present invention.
FIG. 4 is an enlarged, fragmentary and vertical sectional view showing the manner in which an L-shaped member used in the present invention connects with an ornament or decoration in front of the display means.

Referring to FIG. 1, a display means according to the present invention includes a formed housing 1, a rear panel 2 which can be fitted and screwed to the back of the housing 1, at least one master light string 3, and a transmission mechanism 5. The master light string or strings 3 and the transmission mechanism 5 are completely enclosed in the space provided by the housing 1, leaving only a plug 31 connected to the master light string 3 outside of the housing 1 (as shown in FIG. 3 ) for plugging into a common 120 V AC power socket. A plurality of through holes 18 are formed on a front panel 17 of the housing 1, for either bulbs 32 of the light string 3 or transmission shafts of the transmission mechanism 5 to pass therethrough. Stationary ornaments or decorations such as Christmas trees 11, house 12, snowman 13, street lamp 14, etc., as illustrated in FIG. 2, as well as other movable ornaments 15 can be prepared to decorate the front of the housing 1.

Figure 2:
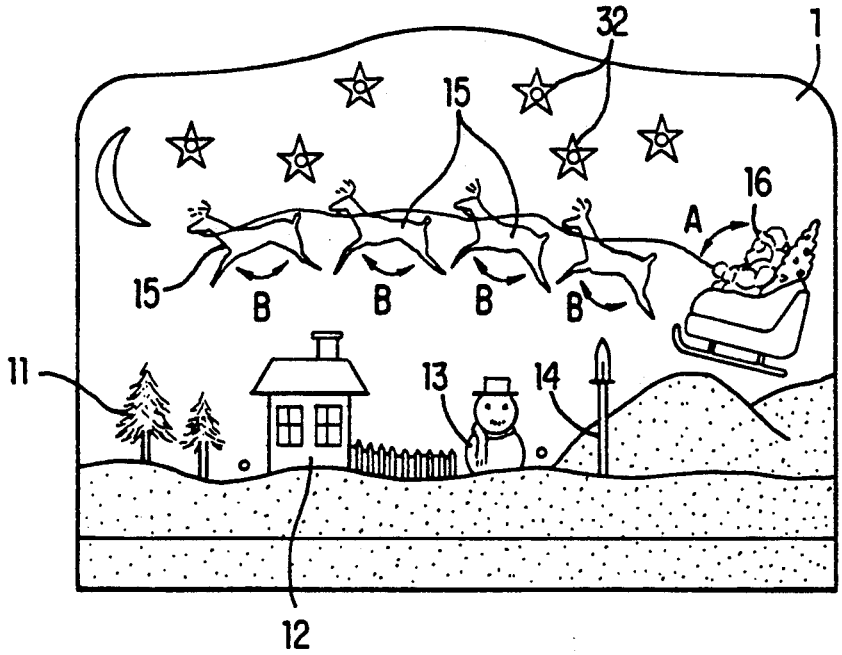
FIG. 2 shows a front view of an embodiment of the display means according to the present invention.
Figure 3:
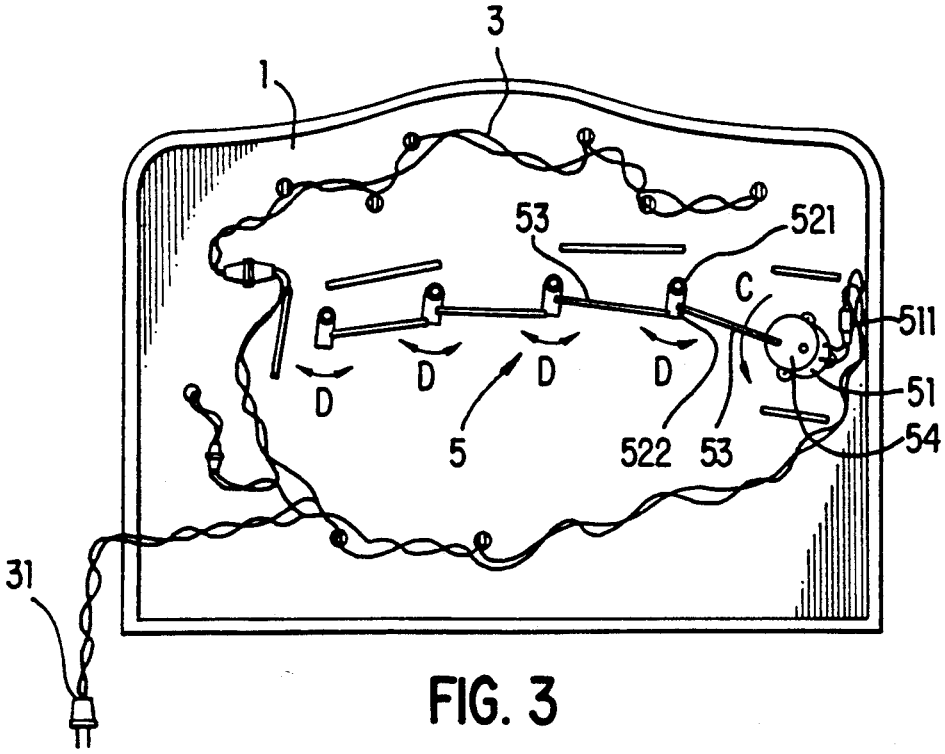
FIG. 3 illustrates a transmission system used in an embodiment of the display means according to the present invention.

The front view as shown in FIG. 2 is used in one of the embodiments of the present invention and is suitable for using in the Christmas season. This embodiment includes Santa Claus 16 on a sled hauled by deer 15 flying over hills, bringing gifts and joys to every family. To make the scene more lively and vivid, deer 15 are designed to sway in the direction as indicated by the arrows B so that it looks like they are running, and the Santa Claus 16 can be connected to an independent AC motor as that disclosed in the U.S. patent application Ser. No. 07/727,439 so that his hand shall move in the direction as indicated by the arrow A and his head shall nod automatically.

In FIG. 3, an appropriate transmission mechanism 5 to achieve the above described motions is shown. The transmission mechanism 5 includes a light string AC motor 51, L-shaped transmission shafts 52, and straight links 53. Each of the transmission shafts 52 further consists of a shaft sleeve portion 521 and a connection plate 522. The shaft sleeve portion 521 of the L-shaped transmission shaft 52 extends forward through one hold 18 to the front face of the housing 1 to movably receive a projected rod 151 provided at a rear side of the ornaments, for example deer in this embodiment. Each of the straight links 53 have has two hooked ends 531 to facilitate connection with the connection plates 522 of the L-shaped transmission shaft 52. One outer end of the first straight link 53 hooks to an eccentric 54 driven by the motor 51 to rotate in the direction as indicated by arrow C. A plug 511 connected with the AC motor 51 can be plugged into any socket to obtain necessary power. When the motor 51 is powered and drives the eccentric 54 to rotate, the shaft sleeve portion 521 of the L-shaped transmission shafts 52 swing back and forth at a constant angle in the direction as indicated by arrow D in FIG. 3. Ornaments 15 in front of the front panel 17 of the housing 1 movably received by the shaft sleeve portion 521 of the L-shaped transmission shafts 52 can swing, accordingly.

The motor 51 is directly connected to the light string so that an appropriate moment is generated to activate the above described motion. The motor is an AC motor as disclosed in the U.S. patent application Ser. No. 07/727,439. Plug 161 connected to the Santa Claus 16 may also pass through the housing 1 to plug into any one of the sockets 33 in the master light string 3 to obtain necessary power required to move. A parallel connected socket 34 can be included in the master light string 3 so as to connect another flashing light string 3', giving the entire display means beautiful changes in light and color. From the above description, it can be seen that the present invention needs only a master light string to serve as the power supply for the entire display means, including the power required by the independent motor for driving the toy figures connected thereto. That is, the present invention shall have different changes in light and color as well as movable ornaments simply with one plug that can be conveniently plugged into a socket.

Referring back to FIG. 1, a hole 21 can be formed at an adequate position on the rear panel 2 to accomodate a set of music IC 4 so that proper music may be used together with the changes in light, color, and motion provided by the transmission mechanism 5 to give the display means better and more interesting effects.

Figure 5:
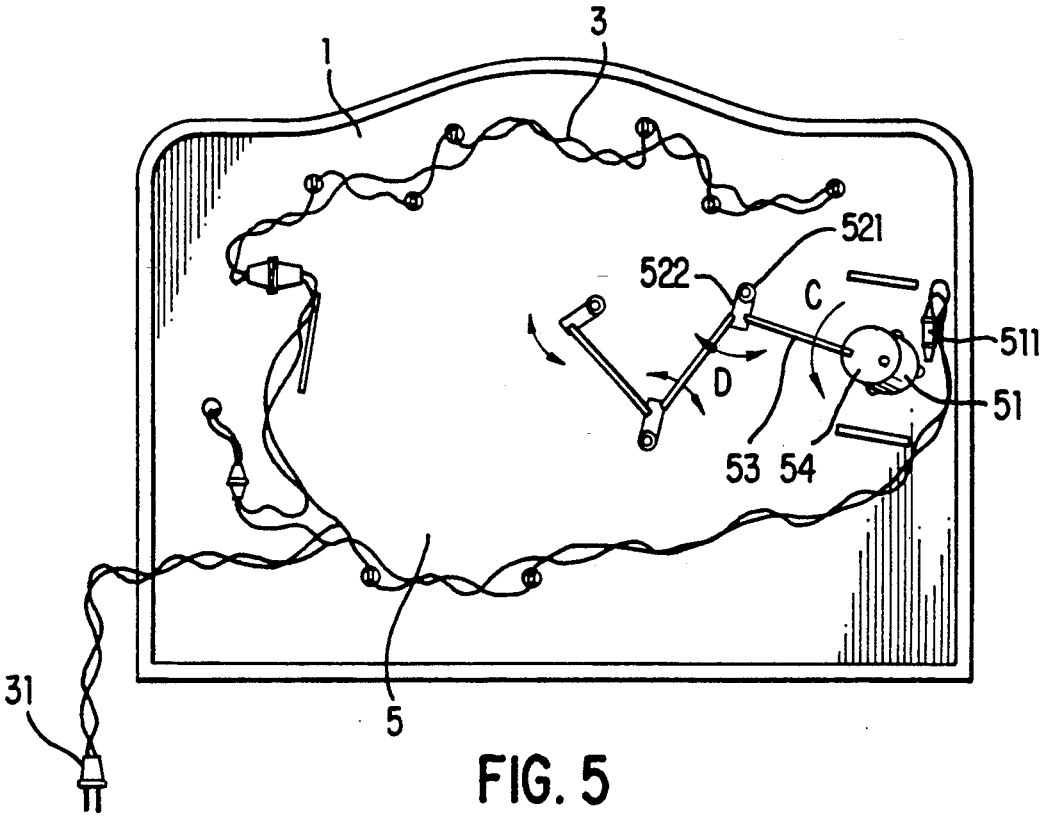
FIG. 5 illustrates another transmission system used in another embodiment of the display means according to the present invention.

The movable deer 15 and Santa Claus 16 as illustrated herein are only examples and should not be used to limit the display means according to the present invention. Different toy figures and ornaments can be arranged depending upon different subjects. The housing 1, rear panel 2, and master light string 3 are necessary basic elements in the display means and the transmission mechanism 5 can be reasonably changed in its design to meet the requirement of different subjects and ornaments. FIG. 5 shows another embodiment of the transmission mechanism used in the present inventon in which the L-shaped transmission shafts 52 are arranged in a way different from the linear arrangement as shown in FIG. 3. That is, the shaft sleeve portion 521 of the transmission shafts 52 may be connected to other steering mechanical means to move in different directions.

What is claimed is:

1. A display means showing movable ornaments, comprising:

a formed housing in a shape suitable for standing alone, comprising a front panel having a picture provided thereon and a plurality of holes therein, stationary and movable ornaments and decorations provided on said front panel, and a rear panel;

at least one master light string provided behind said front panel of said housing, said master light string including bulbs passing through and projecting from said holes provided in said front panel and a plug extending out of said housing to plug in a socket for obtaining necessary power; and a transmission mechanism including a light string AC motor connected to said master light string, and a plurality of transmission shafts driven by said light string AC motor, said transmission mechanism being connected with said movable ornaments for moving said movable ornaments;

the rear panel being in a configuration corresponding to the front panel and being attached thereto so that said master light string and said transmission mechanism are enclosed in said housing.

2. A display means as claimed in claim 1, wherein said movable ornaments are deer and said transmission shafts are L-shaped, each of said L-shaped transmission shafts comprising a shaft sleeve portion and a connection plate, and a plurality of straight links corresponding with said L-shaped transmission shafts, respectively, each of said links having two hooked ends; said shaft sleeve portion of each said Lshaped transmission shafts extending through said front panel of said housing to movably receive a projected rod of an ornament; the hooked ends of said straight links each connecting to respective adjacent connection plates, with an outer end of one of the straight links being connected to an eccentric driven by said AC motor, said AC motor rotating the eccentric, thereby causing said deer in front of said housing to move as though they are running.

3. A display means as claimed in claim 1, wherein a hole is provided on said rear panel to accommodate a music IC.

4. A display means as claimed in claim 1, wherein said master light string has a parallel-connected socket for connecting other light strings.

5. A display means as claimed in claim 4, wherein at least one other light string is connected with said master light string and includes flashing bulbs so as to produce changes in light.

6. A display means as claimed in claim 2, wherein said L-shaped transmission shafts are arranged in a non-linear arrangement.

* * * * *